US006457635B1

(12) United States Patent
Scicluna

(10) Patent No.: US 6,457,635 B1
(45) Date of Patent: Oct. 1, 2002

(54) SHIRT WRAPPER

(75) Inventor: Paul Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 09/800,317

(22) Filed: Mar. 6, 2001

(51) Int. Cl.[7] ..... B65D 85/18
(52) U.S. Cl. ..... 229/87.17; 206/278; 206/292
(58) Field of Search ..... 229/87.15, 87.17; 206/278, 292, 297

(56) References Cited

U.S. PATENT DOCUMENTS

| | | | | |
|---|---|---|---|---|
| 554,876 A | * | 2/1896 | Hosmer | 229/87.15 X |
| 1,385,695 A | | 7/1921 | MacCormack et al. | |
| 1,429,608 A | * | 9/1922 | May | 229/87.15 X |
| 2,232,639 A | * | 2/1941 | Schwartzman | 229/87.15 X |
| 2,269,915 A | * | 1/1942 | Porter | 229/87.15 |
| 2,443,702 A | | 6/1948 | Bruning | |
| 3,024,824 A | | 3/1962 | Bass | |
| 3,622,526 A | | 11/1971 | Robertson | |
| 3,664,572 A | | 5/1972 | Puchoff et al. | |
| 4,562,952 A | | 1/1986 | Chinman | |
| D289,228 S | | 4/1987 | Chinman | |
| 4,881,684 A | | 11/1989 | Chinman | |
| 5,718,331 A | | 2/1998 | Smith | |

FOREIGN PATENT DOCUMENTS

| | | | | |
|---|---|---|---|---|
| JP | 0162275 | * | 7/1991 | 229/87.15 |

OTHER PUBLICATIONS

Copy of clipping from *Travel Smith Outfitting Guide and Catalog*, Spring 1999, p. 47.

* cited by examiner

*Primary Examiner*—Jes F. Pascua
(74) *Attorney, Agent, or Firm*—Baker Botts L.L.P.

(57) ABSTRACT

A shirt wrapper includes a body of a flexible material having a rectangular base and a pair of end flaps that fold up from the base part way over the top of a stack of shirts. A first rectangular side flap folds up along one side and entirely over the top of the stack of shirts. A second side flap folds up along the other side and at least partway over the top of the stack of shirts. A bottom pocket in the base receives a bottom stiffener sheet. A top stiffener sheet of substantially the same size as the bottom stiffener sheet is received in a pocket in the first side flap. A fastener joins the side flaps in folded condition over the stack of shirts.

12 Claims, 3 Drawing Sheets

SHIRT WRAPPER

BACKGROUND OF THE INVENTION

The present invention relates to a wrapper that contains and protects a stack of one or more folded shirts or blouses and is particularly useful as a luggage accessory.

Most articles of clothing that a traveler packs in his or her luggage when traveling need not arrive at a destination wrinkle-free or well-organized. The traveler does, however, want his or her shirts and blouses, especially those used for business and social events, to look good. Shirt wrappers are available commercially as luggage accessories for holding several folded shirts and blouses and protecting them reasonably well from wrinkling.

Examples of previously known shirt wrappers are described and shown in US Patents of Chinman Nos. 4,562,952, 4,881,684, and Des. 269,228. The shirt wrappers of those patents have a fabric body composed of a rectangular base and four flaps, one extending outwardly from each edge of the base. A rectangular stiffener sheet is received in a pocket formed by a rectangular fabric panel that is stitched along three sides to the perimeter of the base. The wrapper also has a separate, loose rectangular stiffener plate, which is used as a "form" for folding the shirts neatly, should it be necessary to do so. (In the latter regard, shirts that come from professional laundries are folded and bound and can be placed in a conventional shirt wrapper without refolding.)

After the user places a stack of folded shirts on the base of the wrapper, the loose stiffener plate is placed on the top of the stack. One pair of opposite flaps are folded over and joined where they overlap by hook and loop fastener strips (VELCRO®). Similarly, the remaining pair of opposite flaps are folded over and joined.

For the most part, shirt wrappers of the type described and shown in the patents referred to above are easy to use and protect the shirts and blouses quite well for transport in a traveler's luggage. The stack of shirts—hereafter, references to "shirts" should be read to include blouses—is contained in a sandwich between the stiffener sheets, which protects the stack from becoming disorganized and the shirts from becoming wrinkled. One drawback of those wrappers is the separate, loose stiffener sheet. When the traveler opens the wrapper to take out a shirt, he or she must first remove the loose stiffener sheet and perhaps set it aside while a particular shirt is selected. If the traveler chooses to keep the shirts in the wrapper rather than unpacking them and hanging them up or putting them in a drawer, the loose stiffener sheet has to be put back. The loose stiffener sheet is also prone to becoming misplaced or lost.

BRIEF SUMMARY OF THE INVENTION

One object of the present invention is to provide a shirt wrapper that is more convenient to use than are those described above. Another object is to minimize the possibility that a top stiffener sheet of a shirt wrapper will be misplaced or lost.

The foregoing objects are attained, in accordance with the present invention, by a shirt wrapper for containing and protecting a stack of folded shirts that includes a body of a flexible material having a rectangular base having narrower end edges and longer side edges. A pair of end flaps, one joined to each of the end edges, are of a length such as to fold up from the base along the ends of the stack of shirts and at least part way over the top of the stack of shirts. A first rectangular side flap is joined to one side edge of the base.

The first side flap has a width equal to the width of the base of the body between the ends and a length such as to fold up along one side of the stack of shirts and entirely over the top of the stack of shirts. A second side flap having a length such as to fold up along the other side of the stack of shirts and at least partway over the top of the stack of shirts extends from the other side edge of the base. A panel of flexible material attached to the base of the body forms with the base a bottom pocket coextensive with the base between the ends. The bottom pocket receives a stiffener sheet, which is substantially coextensive with the base of the body. A panel of flexible material attached to the first side flap forms with the first side flap a top pocket having a width equal to the width of the first side flap, an opening spaced apart from the juncture of the first side flap and an edge coextensive with the free edge of the first side. A top stiffener sheet of substantially the same size as the bottom stiffener sheet is received in the top pocket. A fastener is provided for joining the underside of the second side flap to the top of the first side flap when the wrapper is folded over a stack of shirts.

A shirt wrapper according to the invention provides for retention of the top stiffener sheet in a pocket of the first side flap. Accordingly, the user does not have to remove the top stiffener sheet from the wrapper at any time, except when he or she wants to use it as a form for folding shirts. Once the shirts are folded and stacked on the open wrapper, the user puts the wrapper into the pocket where it can stay until the next time (if ever) the user wants to use it again as a folding form. When the user opens the wrapper to remove one or more shirts, it is not necessary to handle the top stiffener sheet. The need to put the top stiffener sheet back into the wrapper when it is reclosed after removing a shirt is eliminated, and the possibility of misplacing or losing the top stiffener sheet is minimized.

In a preferred embodiment, the base, the first side flap and the second side flap are portions of a single sheet of material, which lies outermost when the wrapper is closed. The panels forming the bottom and top pockets are fastened on the same surface of the single sheet, which surface lies within the wrapper when it is folded over a stack of shirts. The single sheet construction of the base and side flaps provides a good appearance and simplified manufacture. Having the stiffener sheets inside the closed wrapper ensures that they are retained against being dislodged from the pockets.

Preferably, the top pocket is substantially coextensive with the top stiffener sheet so that all or nearly all of the top stiffener sheet resides inside the pocket. Retention of the top stiffener sheet is better ensured when the wrapper is opened and closed.

A preferred fastener for joining the two side flaps is a strip of hook and loop fastener of a length to enable adjustment. The second side flap may be rectangular and substantially coextensive widthwise with the base of the body. In that case, more secure closure is afforded by two strips of hook and loop fastener, each of a length to enable adjustment, located proximate to the ends of the side flaps.

The end flaps may overlap when folded over the stack of shirts. It is possible to leave the end flaps free of any fasteners, inasmuch as they can be held folded over the stack of shirts by friction. On the other hand, an end flap fastener for fastening the free ends of the end flaps when the wrapper is folded over a stack of shirts can be provided for better assurance that the wrapper will not partially open and allow the shirts to be partially or fully dislodged. In one suitable design, the end flaps overlap when folded over the stack of shirts and are joined by an end flap fastener in the form of a strip of hook and loop fastener of a length to enable adjustment. Adjustment enables the end flaps to be folded with different degrees of overlap, depending on the height of the stack of shirts. In another design, the end flap fastener may be formed of elastic bands and a connector, such as a buckle. Fasteners for the end flaps may be based on non-elastic bands and an adjustable connector, such as a buckle having cinch slots in one part.

In preferred embodiments of the invention, the panel forming the bottom pocket is stitched to the base of the body along substantially the entire perimeter of the bottom stiffener sheet so that the bottom stiffener sheet is not removable from the wrapper.

For a better understanding of the invention and its advantages, reference may be made to the following description of exemplary embodiments, taken in conjunction with the accompanying drawings.

DESCRIPTION OF THE EMBODIMENT

Figure 1:
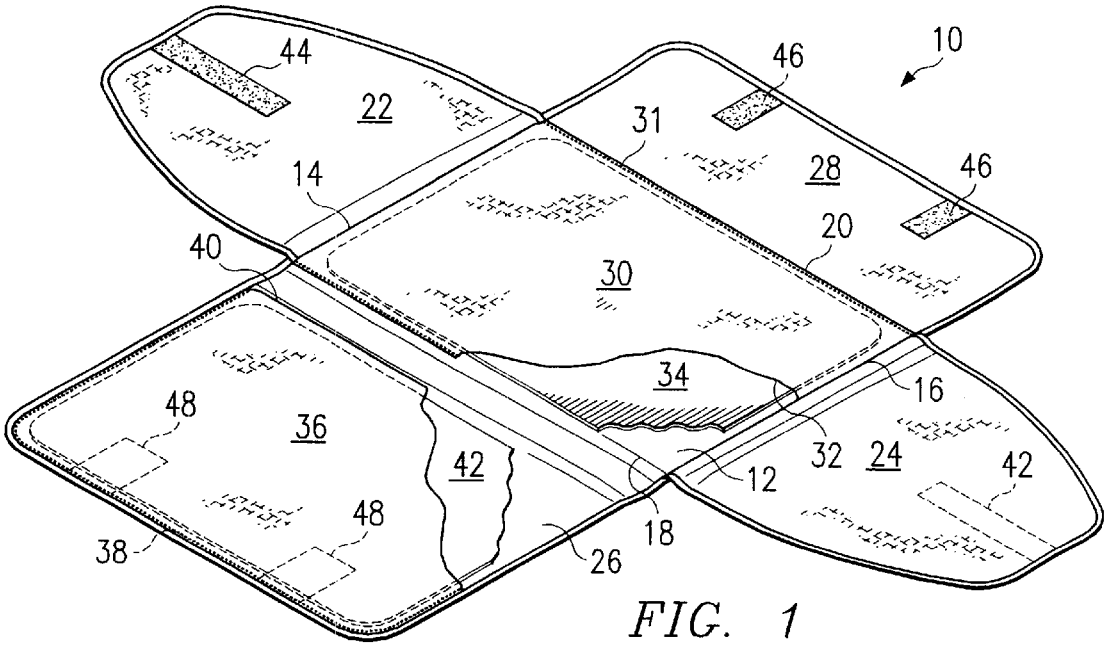
FIG. 1 is a perspective view of a first embodiment, showing it fully open for packing and with portions broken away.

The first embodiment has a body 10 fabricated from durable, flexible sheet materials, such as fabric, artificial leather, or genuine leather—or combinations of such materials. The body is configured to have a rectangular base 12 having shorter end edges 14 and 16 and longer side edges 18 and 20. A pair of end flaps 22 and 24, one at each end of the base 12, extend out from the shorter ends of the base. Each side flap is long enough so that when it is folded up along the respective edge of the base 12, it extends up along the end and partway over the top of a stack of shirts (not shown) placed on the base. In the embodiment, each end flap 22 and 24 is of generally semi-oval shape and has a portion along the juncture with the base 12 that is coextensive with the juncture so that when it is folded over the stack of shirts, that portion covers the end of the stack to contain and protect the shirts. End flaps of other shapes, such as rectangular, trapezoidal or triangular, are possible. The end flaps need not, however, be coextensive with the end edges of the base.

Figure 3:
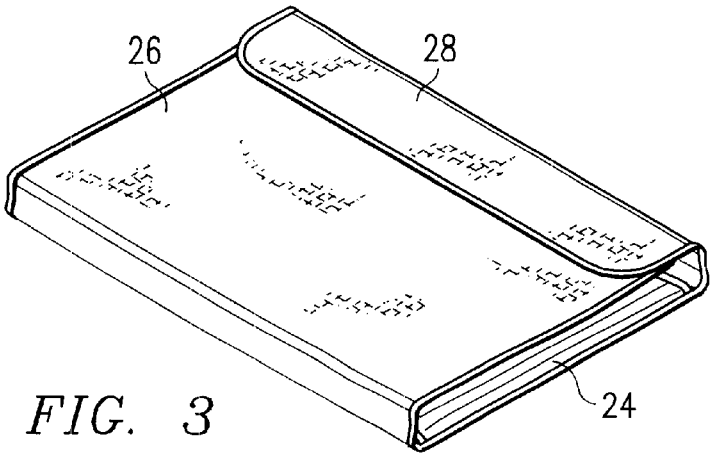
FIG. 3 is a perspective view of the first embodiment, showing it fully closed.

A first side flap 26 is joined to one longer edge 18 of the body 10. The flap 26 is rectangular, of the same width as the base 12, and of a length somewhat greater than the dimension between the side edges 18 and 20 of the base so that when it is folded up along the edge 18, it lies along one side and the entirety of the top of the stack of shirts. A second end flap 28 extends out from the edge 20 of the base 12 and is of a length such that when it is folded up from the base, it lies along the side and partway over the top of the stack of shirts placed on the base 12. In the embodiment, the side flap 28 is rectangular and is coextensive with the juncture with the base along a portion adjacent the base so that when it is folded over the stack of shirts, that portion covers the end of the stack to contain and protect the shirts. The portion of the side flap 28 that overlies the stack of shirts can be of a shape other than rectangular, such as trapezoidal or triangular. The rectangular shape of the embodiment has the advantages of a neat appearance when the wrapper is closed (FIG. 3) and of allowing for two widely spaced fastening points for joining the side flaps in overlapping relation (FIG. 3).

The body 10 of the wrapper may be constructed such that a single sheet of flexible material forms the base 12 and the side flaps 26 and 28 and lies outermost when the wrapper is closed (FIG. 3) and separate end flaps 22 and 24 are stitched along the junctures with the base.

A rectangular panel 30 that is substantially coextensive with the base 12 of the body 10 is stitched along its perimeter (stitch line 31) to the base 12 so as to form a closed pocket 32. Before the panel 30 is joined to the base, a bottom stiffener sheet 34 is placed on the base so as to be contained in the pocket and to render the base 12 semi-rigid. The stiffener sheet 34 may be of HDPE, for example.

A rectangular panel 36 of flexible material is stitched along a stitch line 38 along three sides of the first side flap 26 to form a pocket that is open along an edge 40 proximate to the base 12. A rectangular stiffener sheet 42 of a rigid or semi-rigid material, such as HDPE, is removably received in the pocket. As is known per se, the stiffener sheet 42 may be removed from the pocket and used as a form for folding the shirts that are to be packed in the wrapper. Instructions for how to fold a shirt may be imprinted on the stiffener sheet 42 or on a decal attached to the stiffener sheet. After the user has folded the shirts, the stiffener sheet is returned to the pocket by inserting it through the open edge 40. If the user does not use the stiffener sheet as a form, he or she may leave the stiffener sheet in the pocket.

Figure 2:
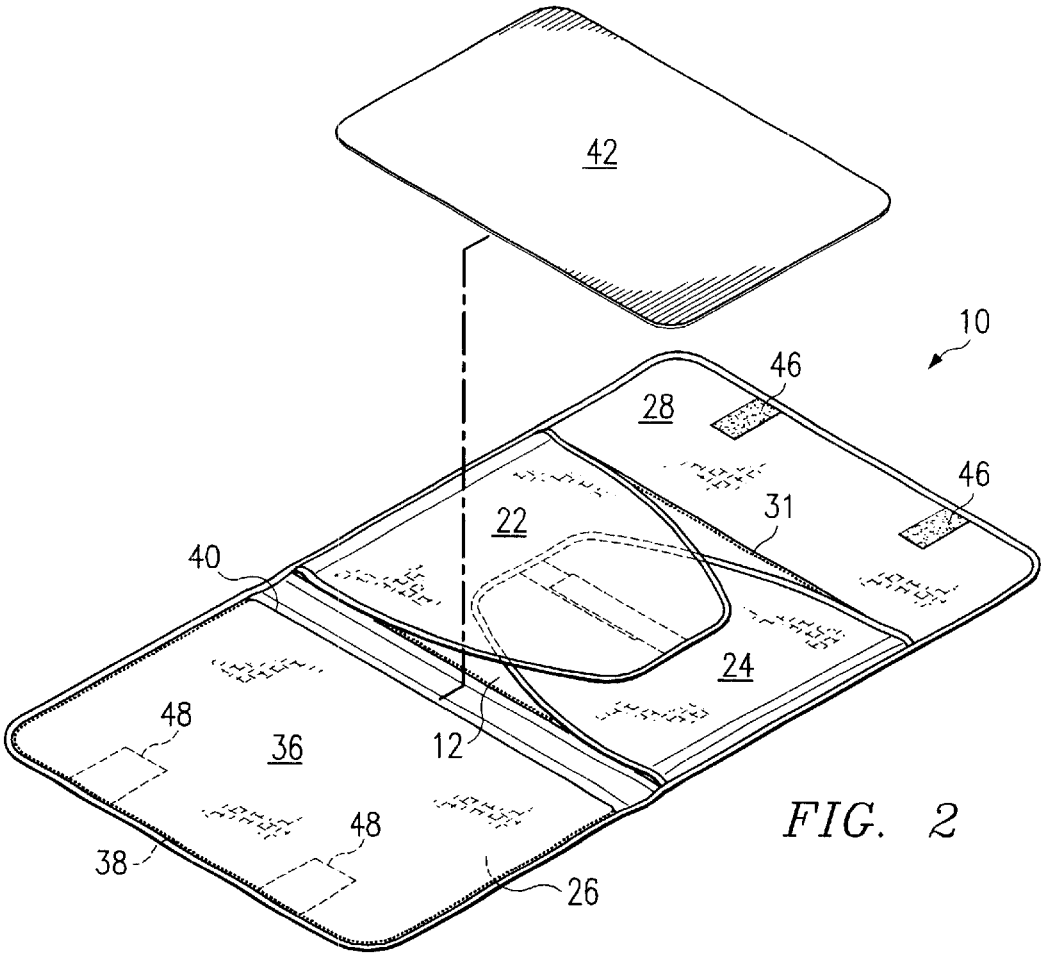
FIG. 2 is a perspective view of the first embodiment, showing it partially closed and showing the removable top stiffener sheet removed from the pocket.

After a stack of shirts has been placed on the base 12, the end flaps 22 and 24 are folded over the stack. Hook and loop fastener strips 43, 44 on the end flaps connect them (FIG. 2). The first side flap 26 (with the stiffener sheet 42 in the pocket) is then folded over the interconnected end flaps and the second side flap 28 is folded over the flap 26 (FIG. 3). A pair of hook and loop fastener strips 46 and 48 on the end flaps 26 and 28 join the end flaps.

Figure 4:
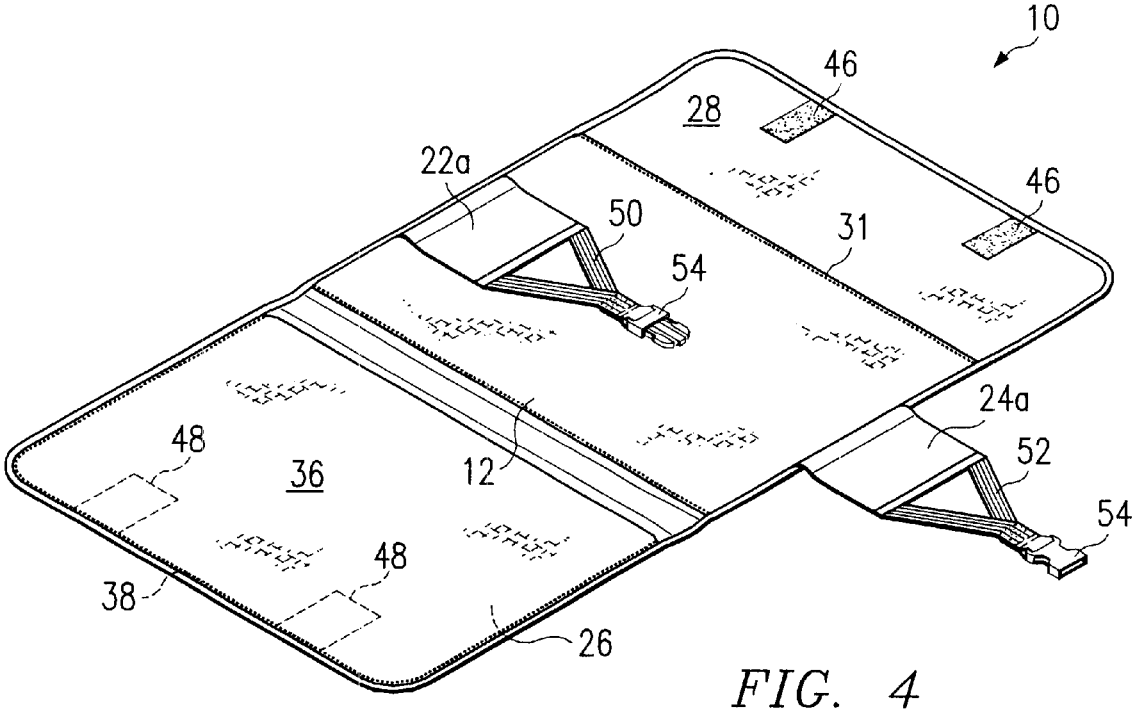
FIG. 4 is a partial perspective view of a second embodiment, showing it partially closed.

The embodiment shown in FIG. 4 is the same as that of FIGS. 1 to 3 except for the sizes and shapes of the end flaps 22*a* and 24*a*, which are rectangular and do not overlap when folded over the stack of shirts. The end flaps 22*a* and 24*a* are joined by loops 50 and 52 of elastic webbing and a buckle 54.

Figure 5:
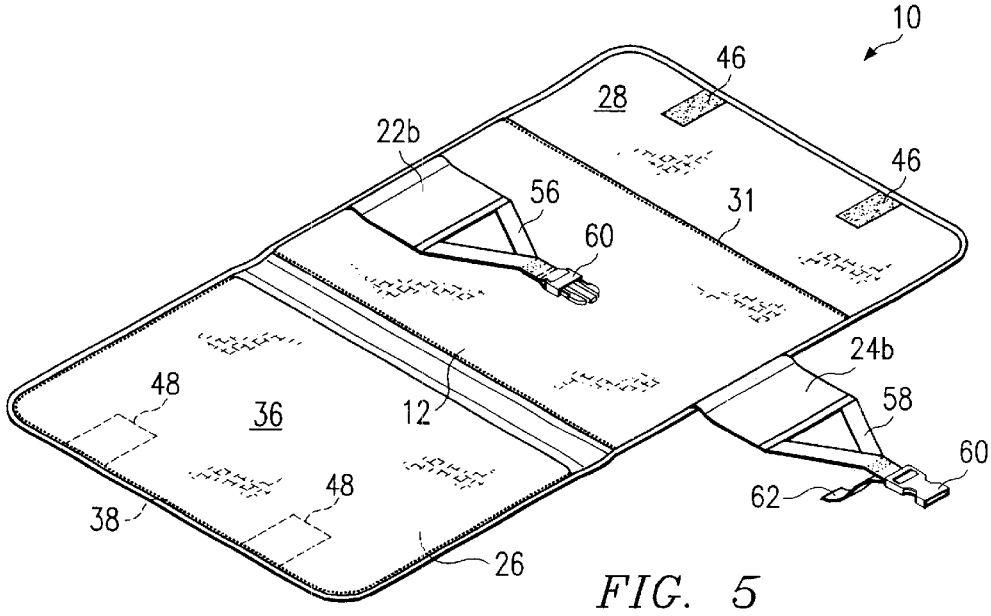
FIG. 5 is a partial perspective view of a third embodiment, showing it partially closed.

Another suitable fastener arrangement for the end flaps 22*b* and 24*b*, as shown in FIG. 5, consists of non-extensible webbing loops 56 and 58 and a buckle 60 of the type having cinch slots in one part that allow adjustment of the length of a strip 62 of the webbing.

Figure 6:
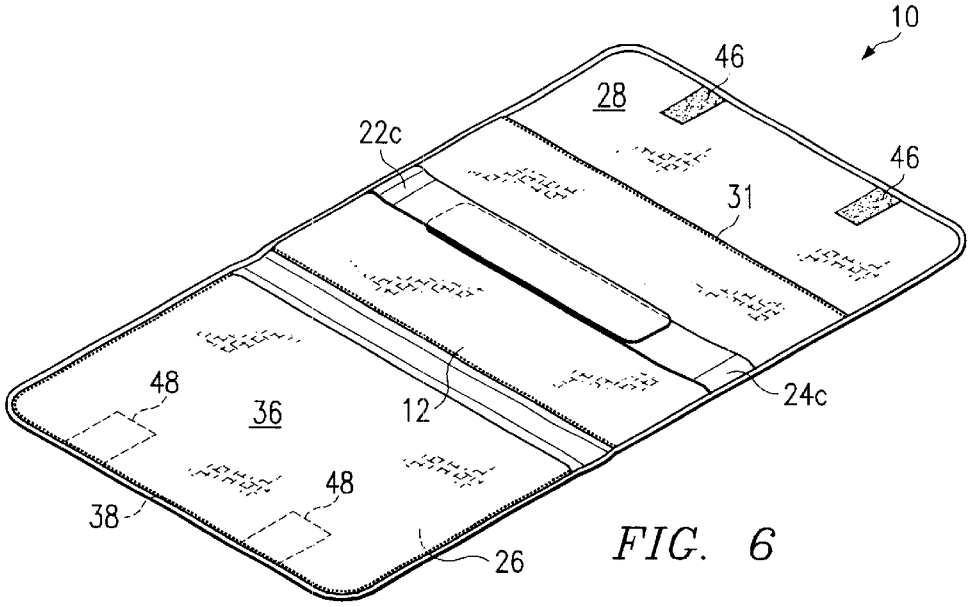
FIG. 6 is a partial perspective view of a fourth embodiment, showing it partially closed.

In the embodiment of FIG. 6, the end flaps 22*c* and 24*c* are long enough to overlap over a major part of the length of the wrapper and do not have fasteners. When the wrapper is closed with the side flaps 26 and 28 snuggly drawn over the stack of shirts and the end flaps 22*c* and 24*c*, friction forces acting along the overlapping portions of the end flaps hold them against slippage and retain the stack of shirts against displacement lengthwise of the wrapper.

What is claimed is:

1. A shirt wrapper for containing and protecting a stack of folded shirts, comprising a body of a flexible material having a rectangular base having narrower end edges and longer side edges and being of a size to receive thereon a folded shirt, a pair of end flaps joined to the end edges, each of the end flaps being of a length such as to fold up from the base along the ends of the stack of shirts and at least part way over the top of the stack of shirts, a first rectangular side flap joined to one side edge of the base, having a width equal to the width of the base of the body between the end edges, and having a length such as to fold up along one side of the stack of shirts and entirely over the top of the stack of shirts, and a second rectangular side flap joined to the other side edge of the base and having a length such as to fold up along the other side of the stack of shirts and at least partway over the top of the stack of shirts;

a panel of flexible material attached to the base of the body and forming with the base a bottom pocket substantially coextensive with the base;

a bottom stiffener sheet substantially coextensive with the base of the body received in the bottom pocket;

a panel of flexible material attached to the first side flap and forming with the first side flap a top pocket having a width equal to the width of the first side flap, an opening spaced apart from the juncture of the first side flap and an edge coextensive with the free edge of the first side;

a top stiffener sheet of substantially the same size as the bottom stiffener sheet received in the top pocket, the top stiffener sheet being removable from the top pocket for use as a form for folding a shirt to be stacked on the base; and a fastener for joining the underside of the second side flap to the first side flap when the wrapper is folded over a stack of shirts.

2. A shirt wrapper according to claim 1, wherein the base, the first side flap and the second side flap include a single sheet of material and the panels forming the bottom and top pockets are fastened on the same surface of the single sheet, which surface lies within the wrapper when it is folded over a stack of shirts.

3. A shirt wrapper according to claim 1, wherein the top pocket is substantially coextensive with the top stiffener sheet.

4. A shirt wrapper according to claim 1, wherein the fastener is a strip of hook and loop fastener of a length to enable adjustment of the positions of the side flaps relative to each other.

5. A shirt wrapper according to claim 1, wherein the second side flap is rectangular and substantially coextensive widthwise with the base of the body.

6. A shirt wrapper according to claim 5, wherein the fastener includes two strips of hook and loop fastener, each of a length to enable adjustment of the positions of the side flaps relative to each other, located proximate the ends of the first and second side flaps.

7. A shirt wrapper according to claim 1, wherein the end flaps overlap when folded over the stack of shirts, are free of any fasteners, and are held folded over the stack of shirts by friction.

8. A shirt wrapper according to claim 1, and further comprising an end flap fastener for fastening the free ends of the end flaps when the wrapper is folded over a stack of shirts.

9. A shirt wrapper according to claim 8, wherein the end flaps overlap when folded over the stack of shirts and the end flap fastener is a strip of hook and loop fastener of a length to enable adjustment of the positions of the end flaps relative to each other.

10. A shirt wrapper according to claim 8, wherein the end flap fastener includes an elastic band and a connector.

11. A shirt wrapper according to claim 8, wherein the end flap fastener includes a non-elastic band and an adjustable connector.

12. A shirt wrapper according to claim 1, wherein the panel forming the bottom pocket is stitched to the body along substantially the entire perimeter of the bottom stiffener sheet so that the bottom stiffener sheet is not removable from the wrapper.

* * * * *